US009802775B2

(12) United States Patent
Hashimoto et al.

(10) Patent No.: US 9,802,775 B2
(45) Date of Patent: Oct. 31, 2017

(54) SHEET SEPARATING DEVICE, SHEET SUPPLYING DEVICE, AND IMAGE FORMING APPARATUS

(71) Applicants: Masato Hashimoto, Kanagawa (JP); Takashi Fukumoto, Kanagawa (JP); Hideaki Takahashi, Kanagawa (JP); Hisayoshi Sugawara, Kanagawa (JP); Munehisa Fuda, Kanagawa (JP); Yasuo Niikura, Kanagawa (JP); Masaki Ishizaki, Kanagawa (JP); Kiyotake Nakamura, Kanagawa (JP); Hidetoshi Kojima, Kanagawa (JP); Toshihiro Okutsu, Kanagawa (JP); Kazunori Konno, Kanagawa (JP); Tatsuya Sugawara, Kanagawa (JP); Kohjiroh Haga, Kanagawa (JP)

(72) Inventors: Masato Hashimoto, Kanagawa (JP); Takashi Fukumoto, Kanagawa (JP); Hideaki Takahashi, Kanagawa (JP); Hisayoshi Sugawara, Kanagawa (JP); Munehisa Fuda, Kanagawa (JP); Yasuo Niikura, Kanagawa (JP); Masaki Ishizaki, Kanagawa (JP); Kiyotake Nakamura, Kanagawa (JP); Hidetoshi Kojima, Kanagawa (JP); Toshihiro Okutsu, Kanagawa (JP); Kazunori Konno, Kanagawa (JP); Tatsuya Sugawara, Kanagawa (JP); Kohjiroh Haga, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 6 days.

(21) Appl. No.: 14/878,411

(22) Filed: Oct. 8, 2015

(65) Prior Publication Data

US 2016/0107854 A1 Apr. 21, 2016

(30) Foreign Application Priority Data

Oct. 15, 2014 (JP) ..... 2014-211271

(51) Int. Cl.
*B65H 5/08* (2006.01)
*B65H 7/02* (2006.01)
(Continued)

(52) U.S. Cl.
CPC ..... *B65H 7/02* (2013.01); *B65H 3/126* (2013.01); *B65H 3/48* (2013.01); *B65H 7/16* (2013.01);
(Continued)

(58) Field of Classification Search
CPC .... B65H 7/16; B65H 29/246; B65H 2406/14; B65H 2406/113; B65H 2406/422;
(Continued)

(56) References Cited

U.S. PATENT DOCUMENTS 5,645,274 A * 7/1997 Ubayashi ..... B65H 1/14 271/104
6,955,348 B2 * 10/2005 Koga ..... B65H 3/128 271/97
(Continued)

FOREIGN PATENT DOCUMENTS

JP 2006-264917 10/2006
JP 2010-037099 2/2010
JP 4492429 4/2010

*Primary Examiner* — Howard Sanders
(74) *Attorney, Agent, or Firm* — Harness, Dickey & Pierce P.L.C.

(57) ABSTRACT

A sheet separating device includes: a lifting nozzle configured to blow air against an end portion of a sheet bundle placed on a sheet loading portion to lift sheets; a separating nozzle configured to separate the sheets; a lifting-nozzle shutter member configured to open and close the lifting nozzle; a separating-nozzle shutter member configured to
(Continued)

open and close the separating nozzle; a lifting-shutter driving mechanism configured to drive the lifting-nozzle shutter member; a separating-shutter driving mechanism configured to drive the separating-nozzle shutter member; and an open/close control unit configured to control the lifting-shutter driving mechanism and the separating-shutter driving mechanism such that the lifting-nozzle shutter member and the separating-nozzle shutter member are opened or closed simultaneously.

20 Claims, 11 Drawing Sheets

(51) Int. Cl.

| | |
|---|---|
| ***B65H 3/12*** | (2006.01) |
| ***B65H 3/48*** | (2006.01) |
| *B65H 7/16* | (2006.01) |
| *B65H 29/24* | (2006.01) |

(52) U.S. Cl.
CPC .... *B65H 29/246* (2013.01); *B65H 2406/1211* (2013.01); *B65H 2406/363* (2013.01); *B65H 2406/414* (2013.01); *B65H 2406/42* (2013.01); *B65H 2511/414* (2013.01); *B65H 2511/524* (2013.01); *B65H 2515/212* (2013.01); *B65H 2557/23* (2013.01); *B65H 2801/06* (2013.01)

(58) Field of Classification Search
CPC ..... B65H 2601/211; B65H 2406/363; B65H 2404/173; B65H 49/325
See application file for complete search history.

(56) References Cited

U.S. PATENT DOCUMENTS

| | | | | |
|---|---|---|---|---|
| 8,191,892 | B2 | 6/2012 | Fuda | |
| 8,955,835 | B2 | 2/2015 | Satoh et al. | |
| 9,284,139 | B2 * | 3/2016 | Otsuka | B65H 3/0833 |
| 2008/0297580 | A1 | 12/2008 | Fukumoto et al. | |
| 2009/0014948 | A1 | 1/2009 | Takahashi | |
| 2011/0148027 | A1 | 6/2011 | Fuda | |
| 2011/0187042 | A1 | 8/2011 | Fuda | |
| 2011/0187044 | A1 | 8/2011 | Utagawa et al. | |
| 2011/0193284 | A1 | 8/2011 | Fuda | |
| 2011/0221119 | A1 | 9/2011 | Fuda | |
| 2012/0133092 | A1 | 5/2012 | Fuda et al. | |
| 2012/0313315 | A1 | 12/2012 | Fukumoto et al. | |
| 2013/0026696 | A1 * | 1/2013 | Matsumoto | B65H 3/128 271/5 |
| 2013/0062827 | A1 | 3/2013 | Fuda | |
| 2013/0087967 | A1 | 4/2013 | Fuda et al. | |
| 2013/0106045 | A1 | 5/2013 | Okutsu et al. | |
| 2013/0334764 | A1 | 12/2013 | Fuda | |
| 2014/0339759 | A1 | 11/2014 | Takahashi et al. | |
| 2014/0339761 | A1 | 11/2014 | Oikawa et al. | |
| 2014/0346728 | A1 | 11/2014 | Fuda et al. | |
| 2015/0166280 | A1 | 6/2015 | Hino et al. | |
| 2015/0225191 | A1 | 8/2015 | Niikura et al. | |

* cited by examiner

SHEET SEPARATING DEVICE, SHEET SUPPLYING DEVICE, AND IMAGE FORMING APPARATUS

CROSS-REFERENCE TO RELATED APPLICATIONS

The present application claims priority to and incorporates by reference the entire contents of Japanese Patent Application No. 2014-211271 filed in Japan on Oct. 15, 2014.

BACKGROUND OF THE INVENTION

1. Field of the Invention

The present invention relates to a sheet separating device, a sheet feeding device, and an image forming apparatus.

2. Description of the Related Art

A sheet supplying device employed in an image forming apparatus such as a copier or a printer to supply a sheet to an image forming unit generally includes a sheet separating device. The sheet separating device separates an uppermost sheet from a bundle of sheets so that the sheet feeding device can supply the sheets one sheet by one sheet. To achieve high productivity and high reliability required of the sheet separating device, the sheet separating device generally adopts a frictional separation method that separates sheets using a sheet feeding roller or an air-assisted separation method that separates sheets by blowing air. The sheet separating device that adopts the air-assisted separation method typically blows separating air against a sheet sucked onto a conveying belt by a negative pressure, thereby separating the second and subsequent sheets.

As an example of such an air-jet-type sheet separating device, a sheet separating device including a shutter unit that is opened and closed at predetermined intervals to increase air-assist effect without increasing the size of an air blower is disclosed in Japanese Patent No. 4492429. More specifically, the sheet separating device includes a sheet feeding tray where sheets are to be placed in a stack, a feeding unit that feeds the sheets placed on the sheet feeding tray one by one from the top of the stack, a fan that blows air against an end surface of the stack of the sheets placed on the sheet feeding tray, and an air-blower control unit that temporarily increases an airflow rate of the air blowing unit. The air-blower control unit includes a shutter member, which closes and opens one of an air inlet port and an air outlet port of the fan, and a shutter driver. The shutter driver includes a solenoid and controls open/close switching of the shutter member by switching energization state of the solenoid. The air-blower control unit causes the shutter driver to close any one of the air inlet port and the air outlet port of the fan and, after a predetermined period of time, open the closed one of the air inlet port and the air outlet port, thereby temporarily increasing the airflow rate when the port is opened.

Meanwhile, conventional sheet separating devices can be poor in sheet separation capability and suffer from occurrence of what is referred to as "multi-feed", i.e., two or more sheets are conveyed together, and therefore are incapable of maintaining stable conveyance performance. That is, the first sheet and the second sheet are conveyed together as a result of failing to separate the first sheet sucked onto a conveying belt from the second sheet lifted in the air.

Furthermore, although the technique disclosed in Japanese Patent No. 4492429 provides an advantage that sheet separation using air-assist effect is improved, the technique cannot solve the multi-feed problem the cause of which is poor separation capability.

Accordingly, there is a need for a sheet separating device that can cause less multi-feed and, therefore, improve separation capability and maintain stable sheet feeding performance.

SUMMARY OF THE INVENTION

It is an object of the present invention to at least partially solve the problems in the conventional technology.

A sheet separating device includes: a lifting nozzle configured to blow air against an end portion of a sheet bundle placed on a sheet loading portion to lift sheets; a separating nozzle configured to separate the sheets; a lifting-nozzle shutter member configured to open and close the lifting nozzle; a separating-nozzle shutter member configured to open and close the separating nozzle; a lifting-shutter driving mechanism configured to drive the lifting-nozzle shutter member; a separating-shutter driving mechanism configured to drive the separating-nozzle shutter member; and an open/close control unit configured to control the lifting-shutter driving mechanism and the separating-shutter driving mechanism such that the lifting-nozzle shutter member and the separating-nozzle shutter member are opened or closed simultaneously.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

A sheet separating device, a sheet feeding device, and an image forming apparatus according to an embodiment of the present invention will be described.

Figure 1:
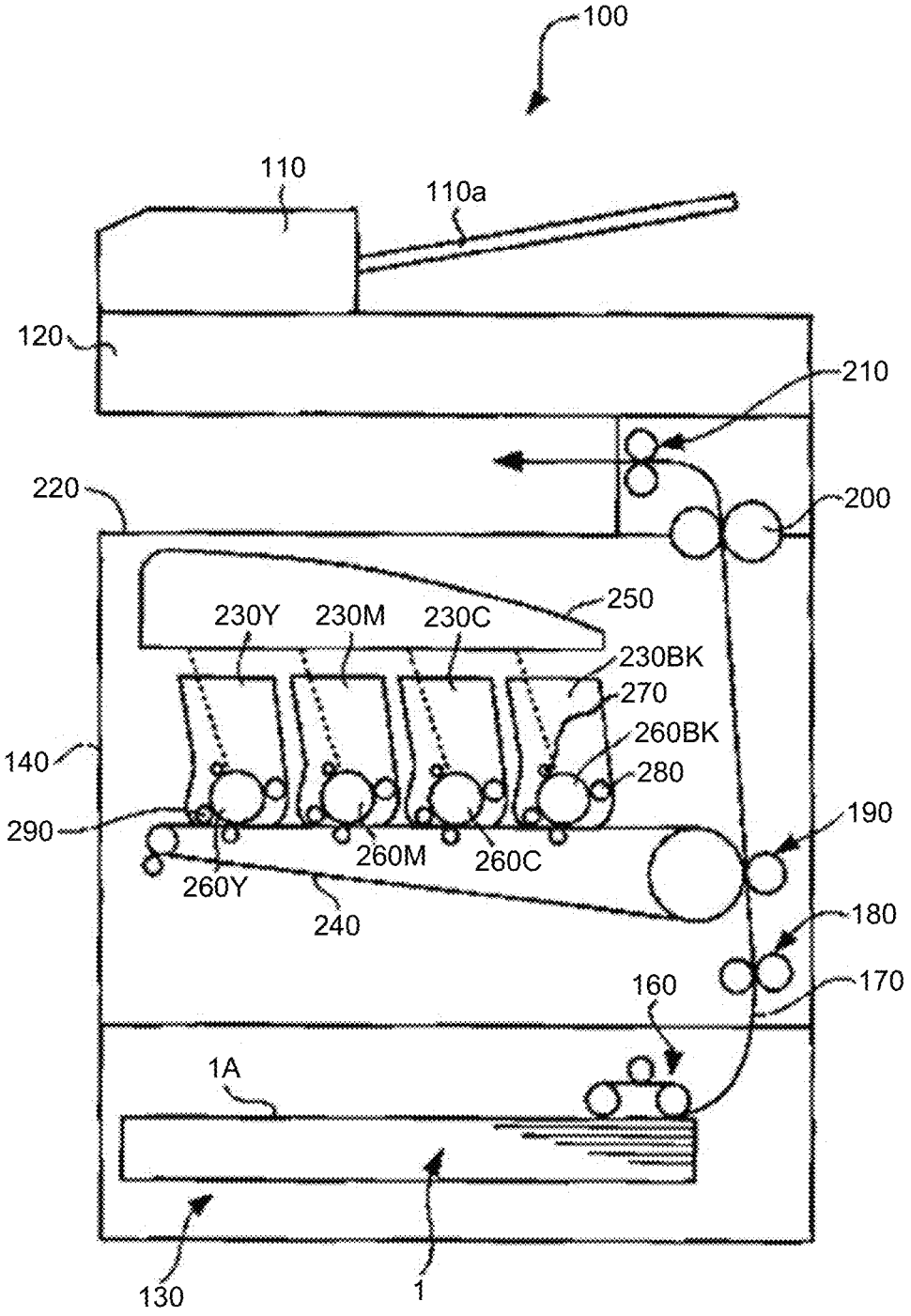
FIG. 1 is a schematic configuration diagram illustrating an image forming apparatus including a sheet separating device according to an embodiment of the present invention.

An image forming apparatus according to an embodiment of the present invention is described below. FIG. 1 is a schematic configuration diagram illustrating the image forming apparatus including a sheet separating device according to an embodiment of the present invention. The present invention may be embodied as an image forming apparatus, which is not limited to the illustrated image forming apparatus, of various types such as a copier, a facsimile, or a multifunction peripheral having a copier function and a facsimile function. The present invention may also be embodied as an image forming system including, in addition to an image forming apparatus, a large-capacity sheet feeding device including a sheet feeding device according to the present invention, and a finisher configured to perform a folding process and/or a binding process, as apparatuses independent of the image forming apparatus.

As illustrated in FIG. 1, an image forming apparatus 100, which is a copier, includes an automatic document conveying device 110, a document reading unit 120, a sheet feeding device 130, a sheet separating device 160, and an image forming unit 140. The automatic document conveying device 110 separates one sheet of original document from a bundle of documents placed on a document tray 110*a* and automatically conveys the document onto an exposure glass on the document reading unit 120. The document reading unit 120 reads the document conveyed onto the exposure glass by the automatic document conveying device 110. A sheet bundle 1 is placed in the sheet feeding device 130. The sheet separating device 160 separates an uppermost sheet 1A from the sheet bundle 1 and conveys the sheet 1A to the image forming unit 140. The image forming unit 140, which is an image forming means, forms the image read by the document reading unit 120 on the sheet conveyed from the sheet feeding device 130.

The sheet feeding device 130 includes a sheet feeding cassette 150, on which the sheet bundle 1 made up of a plurality of sheets is loaded, and the sheet separating device 160, which is a suction conveying unit, that separates and conveys the uppermost sheet 1A from the sheet bundle 1 in the sheet feeding cassette 150. The sheet feeding device 130 which includes an air blowing unit, which will be described later, separates the sheet bundle 1 to reliably separate the uppermost sheet 1A and convey the sheet 1A to the image forming unit 140.

The sheet 1A separated by the sheet separating device 160 is conveyed along a conveyance path 170 by a pair of conveying rollers 180. A toner image formed by the image forming unit 140 is transferred onto the sheet 1A by a transfer roller 190. The toner image is thermally fixed by a fixing device 200. The sheet 1A is then ejected onto a paper ejection tray 220 by a pair of paper ejection rollers 210.

The image forming unit 140 includes four image formation units 230 (230Y (yellow), 230C (cyan), 230M (magenta), and 230BK (black)), an intermediate transfer belt 240 which is a transfer belt, and an exposure device 250.

The exposure device 250 converts color-separated image data fed from an external device such as a personal computer or document image data read by the document reading unit 120 into light-source driving signals. The exposure device 250 emits light beams by driving semiconductor lasers in respective laser light source units in accordance with the signals.

The image formation units 230Y, 230C, 230M, and 230BK form respective images (toner images) of the different colors. Each of the image formation units 230Y, 230C, 230M, and 230BK includes, in addition to a corresponding one of photoconductors 260 (260Y, 260C, 260M, and 260BK) which are image bearers to be rotated clockwise, a charging unit 270, a developing unit 280, and a cleaning unit 290 arranged around the photoconductor 260.

Each of the photoconductors 260 is cylindrically formed and driven to rotate by a drive source (not shown). A photosensitive layer is disposed on the outer circumferential surface of the photoconductor 260. A spot formed on the outer circumferential surface of each of the photoconductors 260 with the light beam, which is indicated by a dotted line, emitted from the exposure device 250 writes an electrostatic latent image in the outer circumferential surface of the photoconductor 260 in accordance with the image data.

The charging unit 270 uniformly charges the outer circumferential surface of the photoconductor 260. A contact-type charging unit that charges the photoconductor 260 in contact therewith is employed as the charging unit 270. The developing unit 280 supplies toner to the photoconductor 260. The supplied toner sticks to the electrostatic latent image written in the outer circumferential surface of the photoconductor 260, thereby developing the electrostatic latent image on the photoconductor 260 into a visible, toner image. The charging unit 270 employed in this example is of a type that does not make contact with the photoconductor 260.

The cleaning unit 290 cleans residual toner sticking to the outer circumferential surface of the photoconductor 260. In this example, a cleaning unit of a brush-contact type that brings a brush into contact with the outer circumferential surface of the photoconductor 260 is employed as the cleaning unit 290.

The intermediate transfer belt 240 is an endless belt formed with a resin film or rubber as a base layer. The toner images formed on the photoconductors 260 are transferred onto the intermediate transfer belt 240, from which the toner images are then transferred by the transfer roller 190 onto a sheet.

First Embodiment

Figure 2:
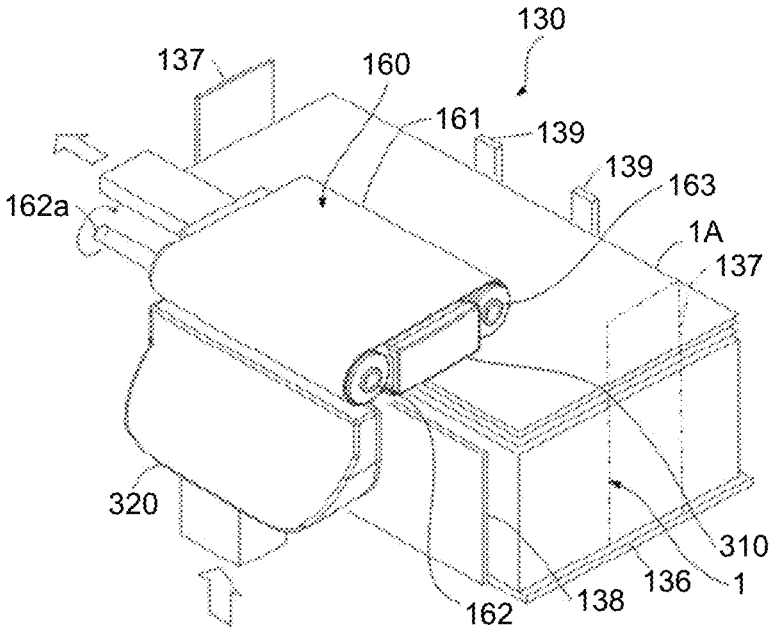
FIG. 2 is a perspective view of a sheet conveying device of the image forming apparatus.
Figure 3:
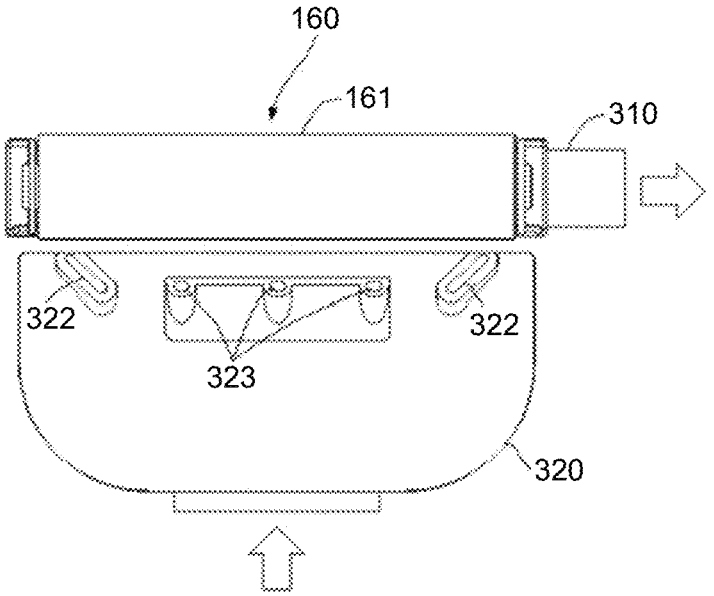
FIG. 3 is a front view of an air-jet nozzle portion of the sheet separating device.
Figure 4:
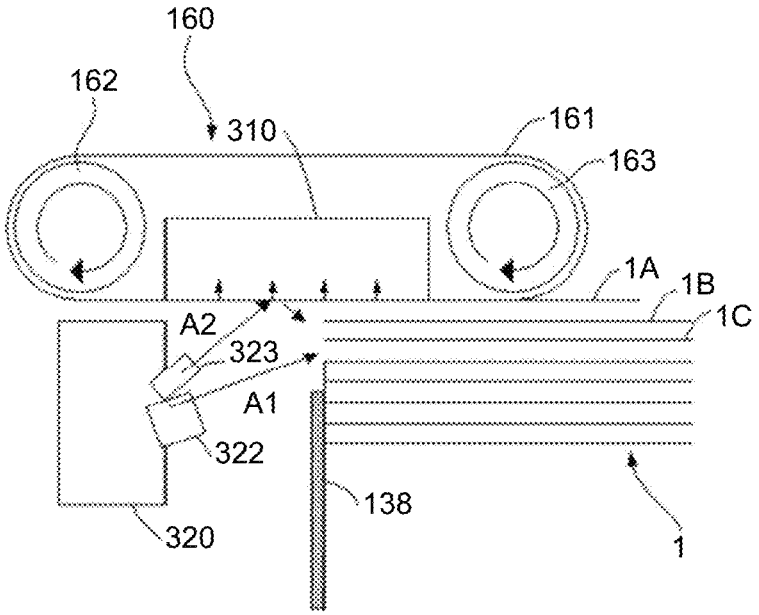
FIG. 4 is a schematic diagram illustrating sheets being separated by the sheet separating device.

Next, the sheet feeding device 130 and the sheet separating device 160 will be described. FIG. 2 is a perspective view of the sheet conveying device of the image forming apparatus. FIG. 3 is a front view of an air-jet nozzle portion of the sheet separating device. FIG. 4 is a schematic diagram illustrating sheets being separated by the sheet separating device. In the sheet feeding device 130, the sheet bundle 1 is placed on a sheet feeding tray 136 which is a bottom plate. The sheet feeding tray 136 can be moved up and down by an elevating function which is a sheet loading portion driver. The sheet feeding device 130 includes a sheet detector that detects a top surface position of the sheet bundle 1 and a sheet-position control unit that controls the top surface position of the sheet bundle 1 by controlling the elevating function. With this configuration, the top surface of the sheet bundle 1 on the sheet feeding tray 136 is brought into contact with the sheet separating device 160, which in turn separates and conveys the uppermost sheet 1A.

The sheet feeding device 130 further includes side fences 137 which are a pair of sheet-position limit members, a front-end guide plate 138, and end fences 139. The side fences 137 are arranged on both sides of the sheet feeding tray 136 in a sheet width direction. The side fences 137 position the sheet bundle 1 placed on the sheet feeding tray 136 in the sheet width direction intersecting (perpendicular to) a sheet conveying direction. The front-end guide plate 138 positions the front end of the sheet bundle 1 in the length direction, which is the sheet feeding direction. Furthermore, the end fences 139 position the trailing end of the sheet bundle 1.

The sheet separating device 160 includes a driving roller 162, a driven roller 163, a conveying belt 161, and a negative-pressure air chamber 310. The driving roller 162 is rotated by a drive shaft 162*a*. The driven roller 163 is rotated by the conveying belt 161 which is rotated by rolling motion of the driving roller 162. The conveying belt 161 is an endless belt member where a large number of suction holes communicating with the negative-pressure air chamber 310 are open. The negative-pressure air chamber 310, in which a negative pressure is maintained by being externally sucked, sucks the uppermost sheet 1A through the suction holes in the conveying belt 161.

An air-jet nozzle unit 300, which is the air blowing unit, is arranged at a position facing the front end of the placed sheet bundle 1. An air chamber 320 where externally-delivered pressurized air is to be stored is disposed in the air-jet nozzle unit 300. As illustrated in FIG. 3, the air chamber 320 includes lifting nozzles 322 and separating nozzles 323. Interior space of the air chamber 320 is partitioned into a section for the lifting nozzles 322 and a section for the separating nozzles 323.

As illustrated in FIG. 4, the lifting nozzles 322 blow lifting air A1 against the front end of the sheet bundle 1 to lift up a sheet from the sheet bundle 1, thereby performing sheet separation. Meanwhile, if the lifting nozzles 322 is configured to blow warm air, dehumidification of recording paper is additionally performed and, as a result, the sheet separation can be performed more effectively. The separating nozzles 323 blow separating air A2 against the conveying belt 161 so that air reflected from the conveying belt 161 pushes down and separates the second and subsequent sheets 1B, 1C, . . . that are in close contact with the uppermost sheet 1A, from the sheet 1A.

At this time, if the lifted second and subsequent sheets 1B, 1C, . . . are lifted excessively or their behavior is disturbed and is thus in contact with the first sheet 1A being conveyed, multi-feed may occur. To avoid this, the lifting air A1 and the separating air A2 are stopped simultaneously to let the second and subsequent sheets 1B, 1C, . . . that are lifted in the air, fall, thereby preventing the second and subsequent sheets 1B, 1C, . . . from contacting the uppermost sheet 1A. Thereafter, blowing the lifting air A1 and the separating air A2 is resumed to convey the second sheet 1B. Meanwhile, to satisfy a desire for increasing a sheet feeding speed, the need of blowing air before the conveyance of the first sheet 1A has been completed may arise. However, blowing air in this manner can cause excessive lifting or disturbance of the behavior, which can result in the multi-feed.

Therefore, the multi-feed at start of air blowing is prevented by causing the lifting air A1 and the separating air A2 to be blown simultaneously from the lifting nozzles 322 and the separating nozzles 323, respectively, to apply an air pressure to the sheet bundle 1 uniformly, thereby reducing excessive lifting and disturbance of the behavior. As a by-product effect, the accuracy of a stop position of the sheet feeding tray 136 in the vertical direction can be increased. More specifically, when the stop position where the sheet feeding tray 136 that is moved up or down is to be stopped is detected by detecting the top surface of the sheet bundle 1, the top surface can be detected inaccurately if the sheets 1A, 1B, 1C, . . . are lifted in the air. However, stopping the lifting air and the separating air lets the sheets 1A, 1B, 1C, . . . fall, thereby allowing accurate detection of the vertical position of the sheet bundle 1.

Figure 5:
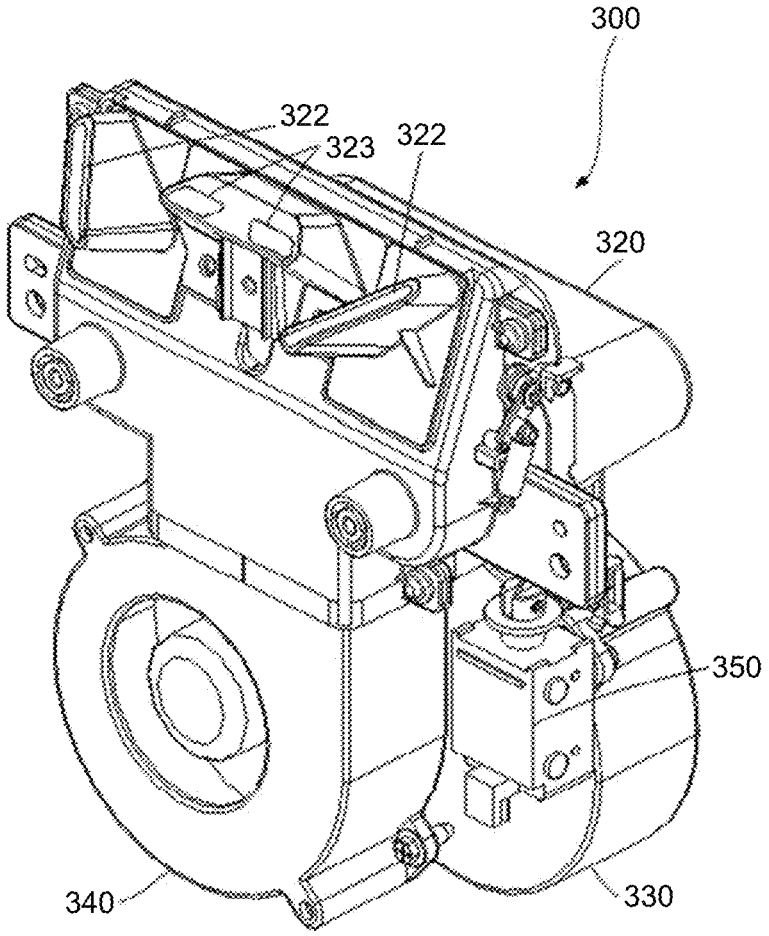
FIG. 5 is a perspective view of the air-jet nozzle unit of the sheet separating device.
Figure 6:
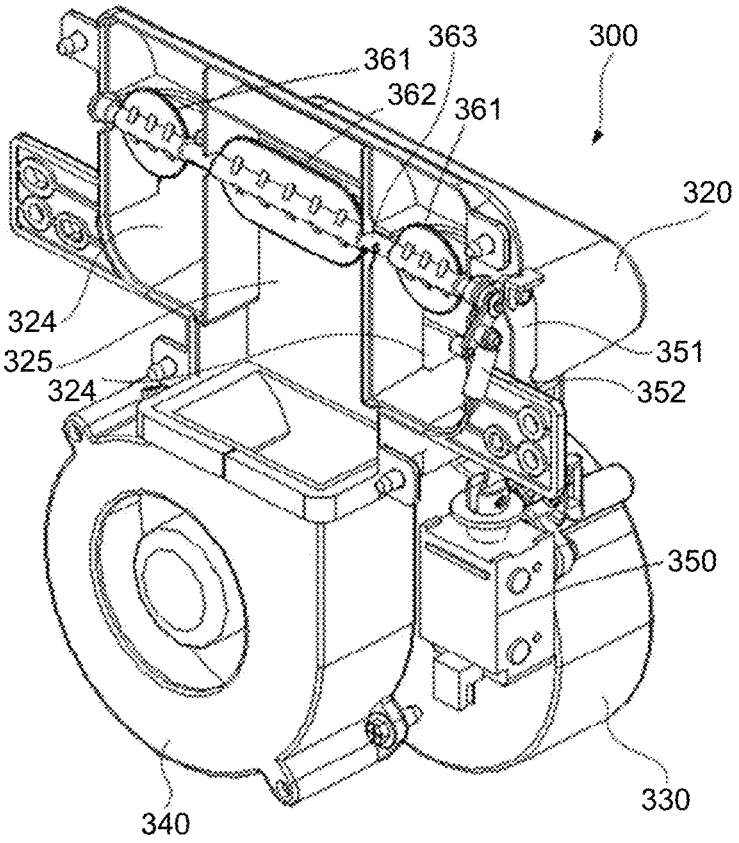
FIG. 6 is a perspective view of the interior of the air-jet nozzle unit of the sheet separating device.
Figure 7:
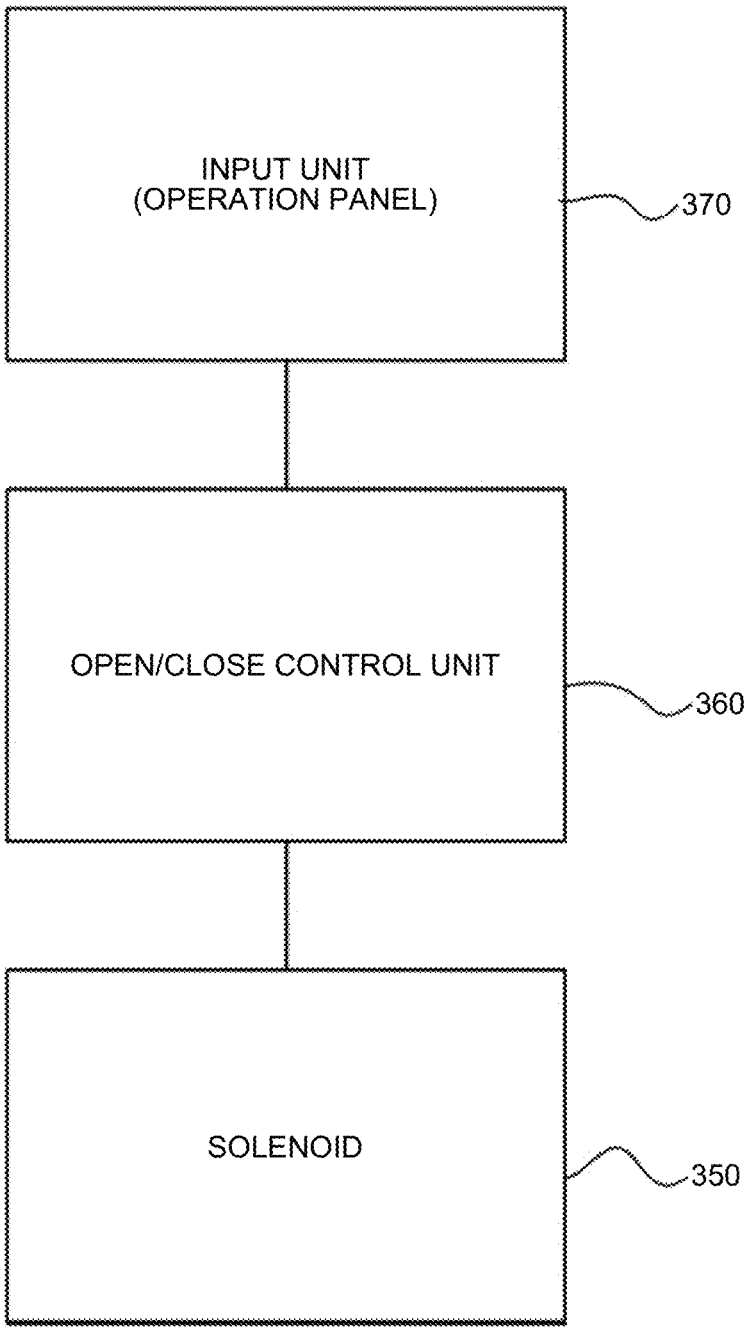
FIG. 7 is a block diagram illustrating an operation control system of the sheet separating device.

Next, how blowing the lifting air A1 and the separating air A2 is controlled is described. FIG. 5 is a perspective view of the air-jet nozzle unit of the sheet separating device. FIG. 6 is a perspective view of the interior of the air-jet nozzle unit of the sheet separating device. FIG. 7 is a block diagram illustrating an operation control system of the sheet separating device.

As illustrated in FIGS. 5 and 6, the interior space of the air chamber 320 is partitioned into a lifting-air chamber section 324 and a separating-air chamber section 325. A lifting blower 330 is connected to the lifting-air chamber section 324. A separating blower 340 is connected to the separating-air chamber section 325.

As illustrated in FIG. 6, lifting-nozzle shutter members 361 that can shut off air delivered into the lifting nozzles 322 are arranged in the lifting-air chamber section 324 of the air-jet nozzle unit 300. A separating-nozzle shutter member 362 that can shut off air delivered into the separating nozzles 323 is arranged in the separating-air chamber section 325. Each of the lifting-nozzle shutter members 361 and the separating-nozzle shutter member 362 is a plate-like member and disposed on a same drive shaft 363 to pivot to open and close.

The drive shaft 363 is coupled via a coupling rod 351 to a solenoid 350 which is a lifting-shutter drive mechanism and a separating-shutter driving mechanism. The lifting-nozzle shutter members 361 and the separating-nozzle shutter member 362 are driven to open or close by the solenoid 350. A spring 352 is arranged on the drive shaft 363 to constantly urge the drive shaft 363 to thereby normally place the lifting-nozzle shutter members 361 and the separating-nozzle shutter member 362 in a closed state.

The solenoid 350 is driven in accordance with sheet conveyance operation performed by the sheet separating device 160 to drive the lifting-nozzle shutter members 361 and the separating-nozzle shutter member 362 so that the lifting air and the separating air are blown or stopped simultaneously. Blowing or stopping the lifting air A1 and the separating air A2 in synchronization with each other makes the air pressure uniform and steadies the behavior of the sheets, thereby preventing multi-feed. Meanwhile, it is not necessary to stop blowing air from the lifting nozzles 322 and the separating nozzles 323 strictly simultaneously, and a certain time lag causes no problem.

FIG. 7 is a block diagram illustrating the operation control system of the sheet separating device. The solenoid 350 is connected to an open/close control unit 360. The open/close control unit 360 drives the solenoid 350 immediately before the sheet 1A is conveyed to bring the lifting-nozzle shutter members 361 and the separating-nozzle shutter member 362 into the closed state. The open/close control unit 360 thus lets sheets other than the sheet sucked onto the conveying belt 161 fall, thereby preventing multi-feed.

The open/close control unit 360 drives the solenoid 350 during conveyance of the sheet 1A to bring the lifting-nozzle shutter members 361 and the separating-nozzle shutter member 362 into an open state. The open/close control unit 360 thus lifts up the second and subsequent sheets 1A, 1B, 1C, . . . in the air so that the sheet can be sucked onto the conveying belt 161, thereby preventing sheet conveyance failure, reducing idle time, and increasing productivity.

The image forming apparatus 100 according to the first embodiment prevents multi-feed by stopping blowing the separating air during sheet conveyance, thereby reducing disturbance of the behavior of the sheets that would otherwise be caused by air. Accordingly, the image forming apparatus 100 can increase separation capability and therefore can reduce occurrence of multiple sheet feed.

Second Embodiment

Figure 8:
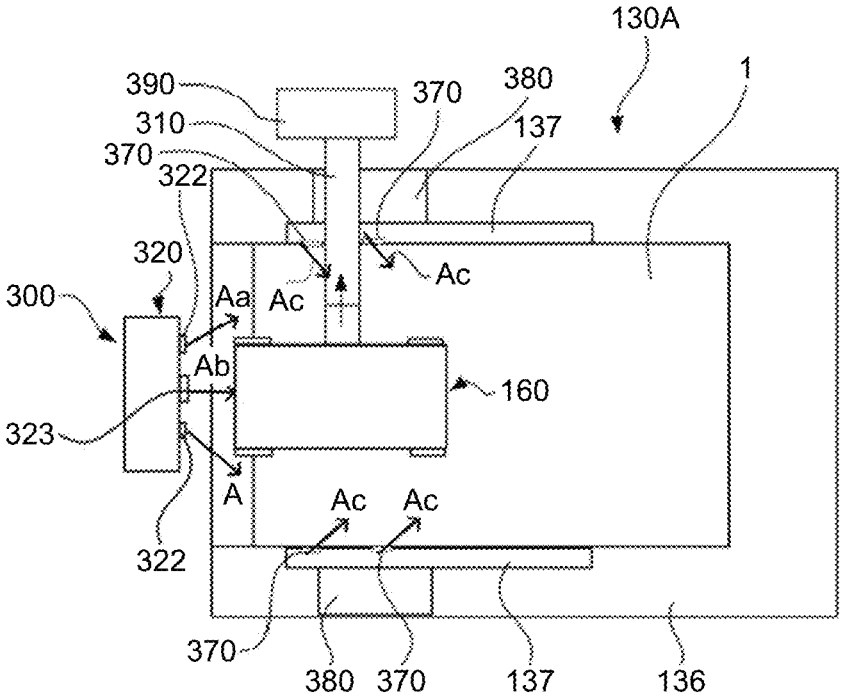
FIG. 8 is a plan view of a sheet separating device according to a second embodiment of the present invention.
Figure 9:
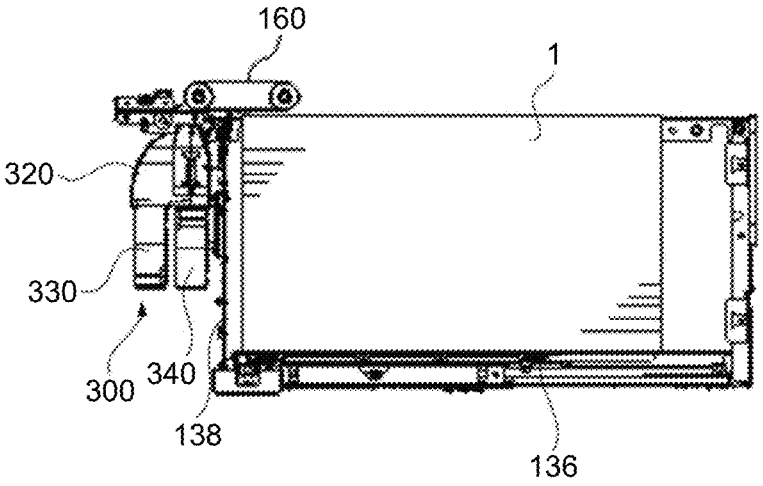
FIG. 9 is a cross-sectional view of a sheet conveying device including the sheet separating device.
Figure 10A:
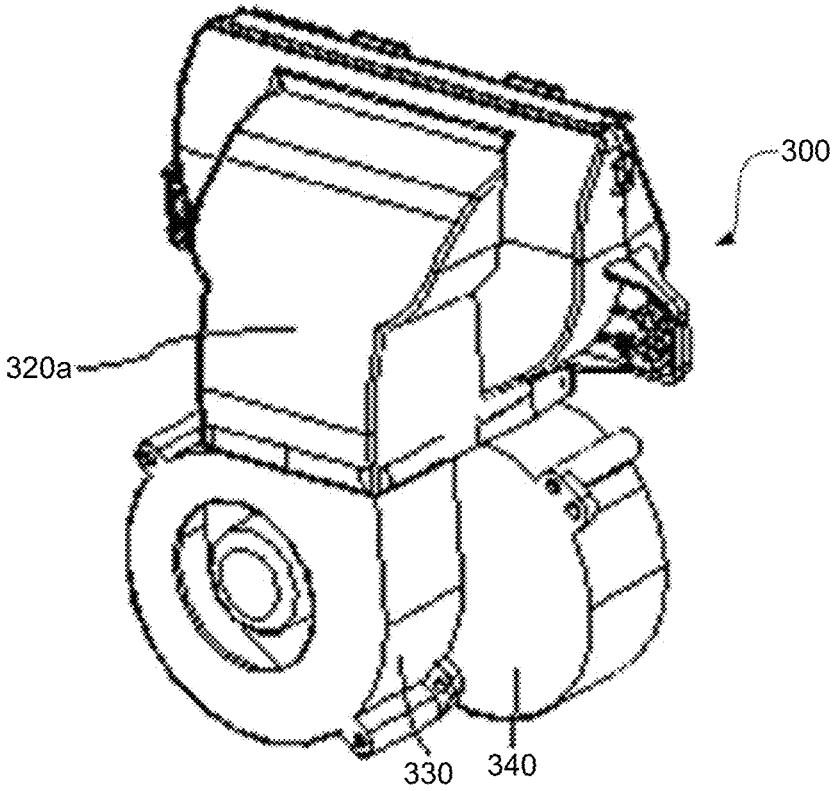
FIGS. 10A and 10B are perspective views of the air-jet nozzle unit of the sheet separating device.
Figure 10B:
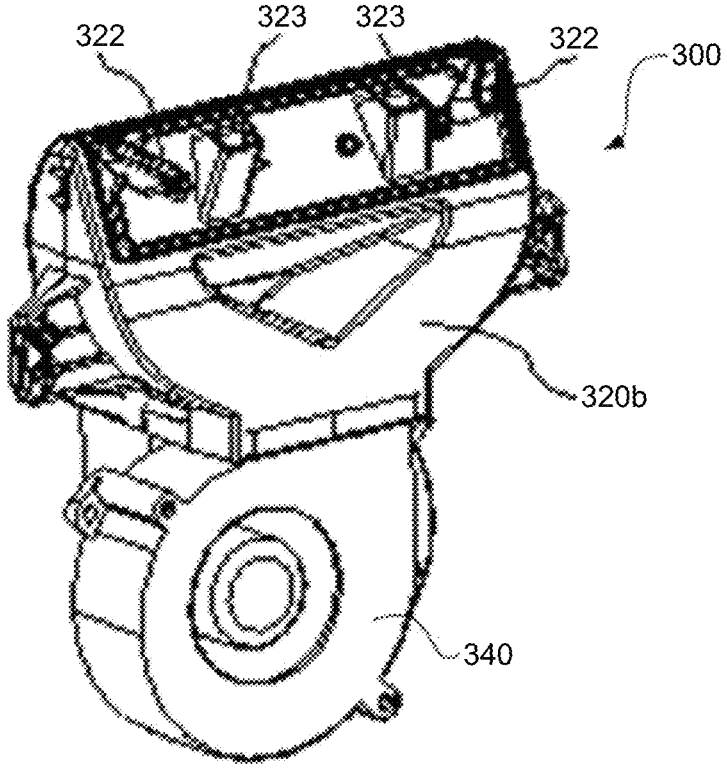
Figure 11:
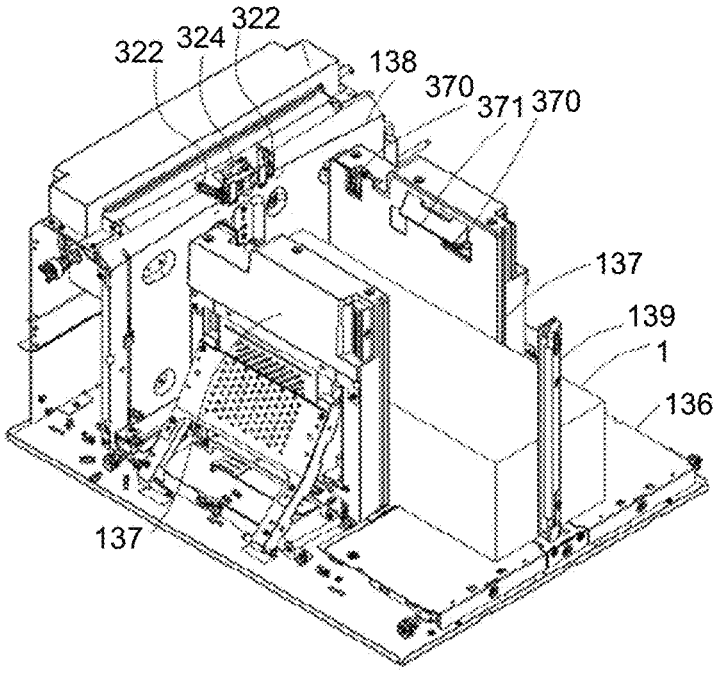
FIG. 11 is a perspective view of the sheet conveying device including the sheet separating device.

Next, a sheet feeding device according to a second embodiment of the present invention is described. FIG. 8 is a plan view of a sheet separating device according to the second embodiment of the present invention. FIG. 9 is a cross-sectional view of the sheet conveying device including the sheet separating device. FIGS. 10A and 10B are perspective views of the air-jet nozzle unit of the sheet separating device. FIG. 11 is a perspective view of the sheet conveying device including the sheet separating device.

As does the sheet feeding device 130 according to the first embodiment, a sheet feeding device 130A according to the second embodiment includes the air-jet nozzle unit 300 and blows the lifting air A1 and the separating air A2 from the lifting nozzles 322 and the separating nozzles 323, respectively. Furthermore, the sheet feeding device 130A blows side air A3 from side air nozzles 370 against a side surface of the sheet bundle 1. The side air A3 is blown from the side air nozzles 370 disposed in the side fences 137. A side blower 380, which is a side air blowing unit, is connected to the side air nozzles 370. The side air nozzles 370 are arranged in the side fences 137 as illustrated in FIG. 11. A sheet-ascent limiting member that prevents a sheet(s) from being lifted in the air higher than the sheet-ascent limiting member is indicated by reference numeral 371 in FIG. 11.

In the second embodiment, as illustrated in FIG. 8, a suction blower 390 serving as an air suction unit is connected to the negative-pressure air chamber 310 of the sheet separating device 160 to place the negative-pressure air chamber 310 in a negative-pressure state. Furthermore, in the air-jet nozzle unit 300, the lifting blower 330 serving as a lifting blowing unit is connected to the lifting nozzles 322; the separating blower 340 serving as a separating blowing unit is connected to the separating nozzles 323. In the second embodiment, as illustrated in FIGS. 10A and 10B, the negative-pressure air chamber 310 includes a separating chamber section 320*a*, from which air is delivered to the separating nozzles 323, and a lifting chamber section 320*b*, from which air is delivered to the lifting nozzles 322.

In the sheet feeding device 130A according to the second embodiment, a flow-rate control unit controls a blowing rate of the lifting blower 330, a blowing rate of the separating blower 340, a blowing rate of the side blower 380, and a suction rate of the suction blower 390 in accordance with a plurality of preset operation modes. As the operation modes, "normal mode", "multi-feed improvement" mode for improving multiple-sheet-feed, "no-sheet-feed improvement" mode for improving no-sheet-feed, and like modes may be provided. As the operation modes, in place of "multi-feed improvement" and "no-sheet-feed improvement", for example, "standard", "multi-feed improvement: medium", "multi-feed improvement: strong", "no-sheet-feed improvement: medium", "no-sheet-feed improvement: strong" may be provided as required. Setting values of flow rates of the respective blowers in each mode are preferably determined in advance by carrying out experiment or the like.

Figure 12:
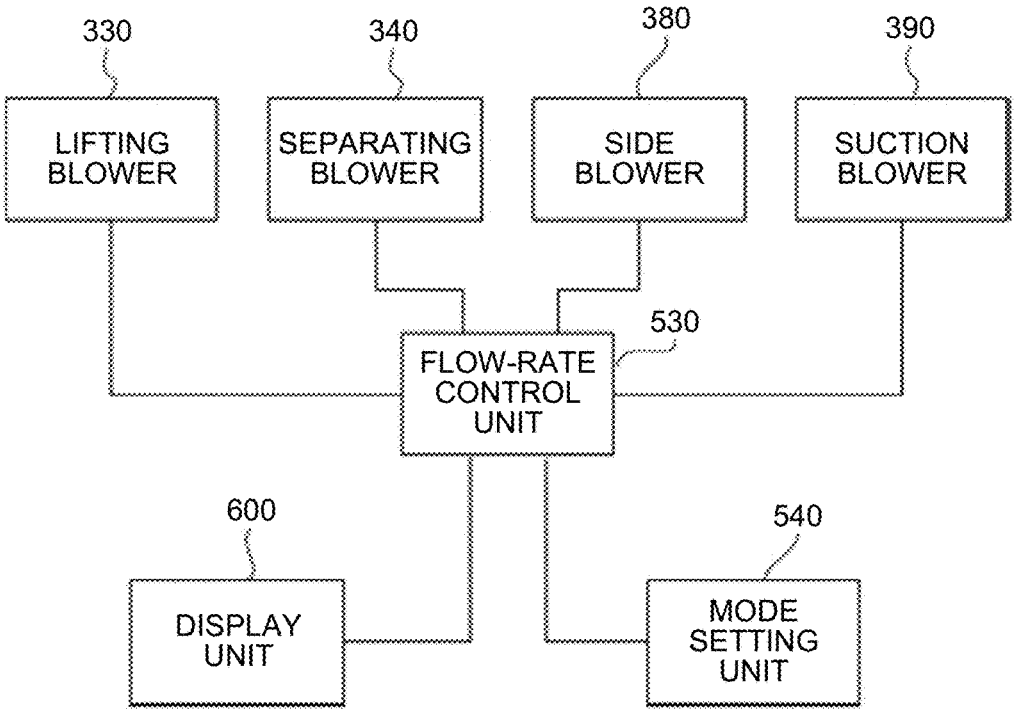
FIG. 12 is a block diagram illustrating a control system of the sheet separating device.

FIG. 12 is a block diagram illustrating a control system of the sheet separating device. The lifting blower 330, the separating blower 340, the side blower 380, and the suction blower 390 are connected to a flow-rate control unit 530. The flow-rate control unit 530 adjusts the blowing rate of the lifting blower 330, the blowing rate of the separating blower 340, the blowing rate of the side blower 380, and the suction rate of the suction blower 390 or, in short, the flow rates of the blowers, by controlling rotation speeds of drive motors of the respective blowers.

The flow-rate control unit 530 is connected to a mode setting unit 540. The flow-rate control unit 530 selects one of the operation modes configured and stored in advance in the mode setting unit 540 and controls the respective blowers in accordance with the selected operation mode. The flow-rate control unit 530 is connected also to a display unit 600 of the image forming apparatus. The display unit 600 displays a state of the flow-rate control unit 530 and receives an input designating one of the operation modes.

The mode setting unit 540 stores the flow rates of the respective blowers in each of the operation modes. The display unit 600 may be an operation panel embodied as a liquid-crystal touch panel, for example, of the image forming apparatus. One of the operation modes is designated from the display unit 600.

Figure 13:
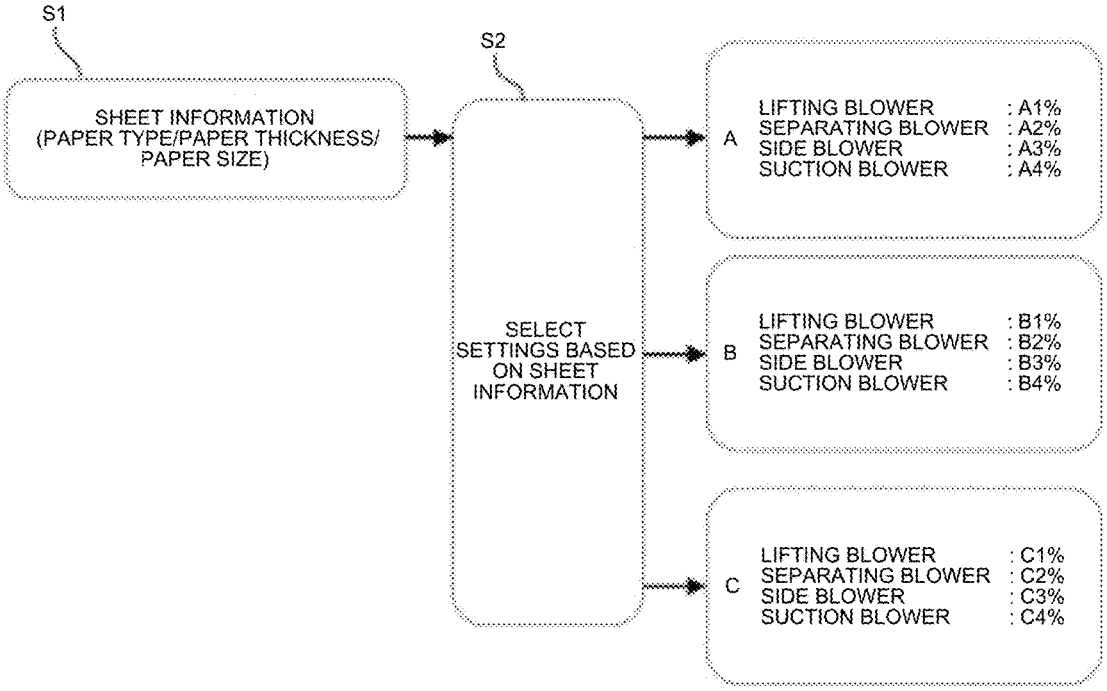
FIG. 13 is a diagram illustrating control employed in a conventional sheet separating device.
Figure 14:
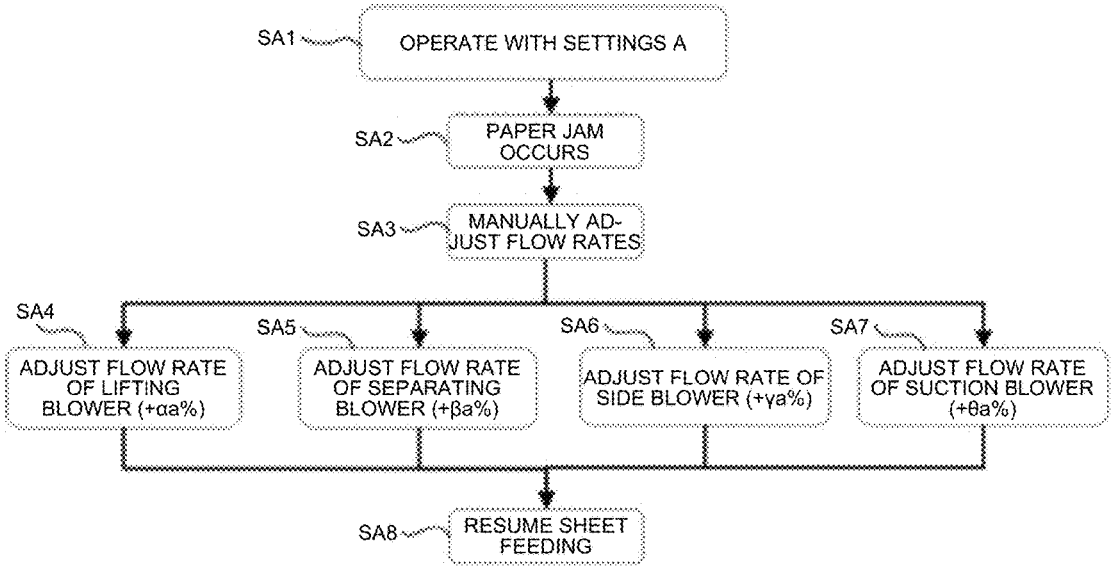
FIG. 14 is a flowchart of processes performed by the conventional sheet separating device when paper jam occurs.

Conventionally, in a sheet feeding device, appropriate airflow rates of the lifting blower 330, the separating blower 340, the side blower 380, and the suction blower 390 are automatically determined based on sheet information including paper type, paper thickness, and paper size of the sheet bundle 1 placed in the sheet feeding device. How the flow rates of the respective blowers are adjusted in such a sheet feeding device when paper jam occurs is described below. FIG. 13 is a diagram illustrating control employed in a conventional sheet separating device. FIG. 14 is a flowchart of processes performed by the conventional sheet separating device when paper jam occurs.

The flow rates of the respective fans are automatically determined (S2) based on sheet information (S1) such as paper type, paper thickness, or paper size as illustrated in FIG. 13. In the example illustrated in FIG. 13, three types of settings A, B, and C are provided. For example, in the settings A, the flow rate of the lifting blower 330 is A1%; the flow rate of the separating blower 340 is A2%; the flow rate of the side blower 380 is A3%; the flow rate of the suction blower 390 is A4%. Each value of each blower in each of the settings is the percentage of the flow rate to a maximum flow rate of the blower. For example, a flow rate for sheets of thin paper may be relatively small, while a flow rate for sheets of thick paper may be relatively large.

However, in a case where sheets are in a special disturbing condition such that, for example, the sheets are largely curled, or wrinkled or swelled due to moisture and/or temperature, even if the flow rates of the respective blowers are set based on sheet information, it cannot cope with such sheets. More specifically, paper jam, no-sheet-feed, or a like problem can occur during conveyance of a sucked sheet. Accordingly, if such a trouble occurs, the flow rates are to be manually adjusted to cope with the sheets in the special condition.

As illustrated in FIG. 14, for example, if paper jam occurs (SA2) in the state of operating with the settings A based on the sheet type (SA1), the airflow rates of the respective blowers are manually adjusted (SA3). More specifically, the flow rates of the respective blowers are increased by predetermined percentages. In this example, the flow rates of the lifting blower 330, the separating blower 340, the side blower 380, and the suction blower 390 are increased by αa %, βa %, γa %, and θa %, respectively (SA4 to SA7). However, such manual adjustment requires a user to enter specific values for a plurality of items, which is complicated and troublesome.

To avoid this inconvenience, in the sheet separating device according to the second embodiment, the flow-rate control unit 530 performs setting depending on a condition such as multiple-sheet-feed or no-sheet-feed with consideration given to effect of lifting and separation of sheets, rather than individually setting the flow rates of the respective blowers. Hence, the sheet separating device according to the second embodiment can perform sheet feeding conveyance favorably while eliminating the need of manually adjusting a number of settings depending on a condition of sheets.

The sheet separating device according to the second embodiment is manufactured to provide a large number of conceivable operation modes. In this example, the operation modes "standard", "multi-feed improvement", and "no-sheet-feed improvement" are provided. Operating conditions for the respective blowers in each of the modes may be determined in advance by carrying out experiment or the like.

An appropriate one of these modes is to be selected by a user. By selecting a mode in this manner, the flow rates of the lifting blower 330, the separating blower 340, the side blower 380, and the suction blower 390 can be adjusted appropriately without performing complicated adjustment.

Figure 15:
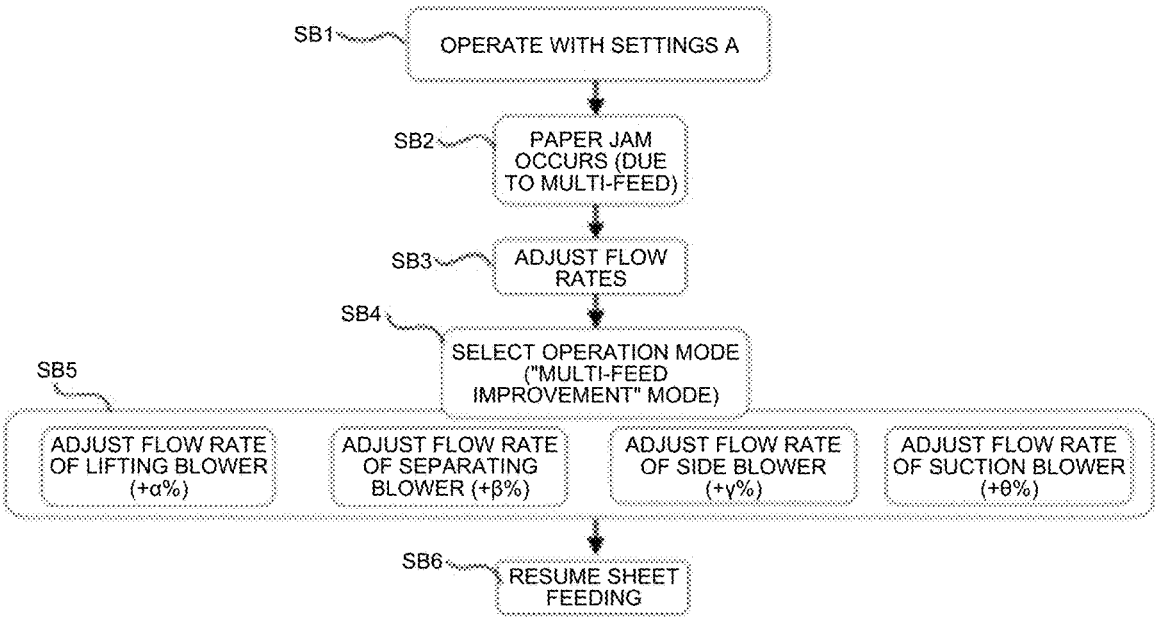
FIG. 15 is a flowchart of processes performed by the sheet separating device according to the second embodiment when paper jam occurs.

FIG. 15 is a flowchart of processes performed by the sheet separating device according to the second embodiment when paper jam occurs. Assume that, for example, paper jam is caused by multi-feed which is caused by excessively strong air flow. In this case, the need of reducing the airflow rate by a certain percentage arises. This need has conventionally been met by performing complicated adjustment, for example, to maintain the flow rates of the suction blower 390 and the separating blower 340 while reducing the flow rates of the side blower 380 and the lifting blower 330.

If multi-feed occurs in the sheet feeding device 130, the flow rates of the blowers can be adjusted only by simply selecting the "multi-feed improvement mode" as illustrated in FIG. 15. This will be described more specifically below. Assume that paper jam occurs due to multi-feed (SB2) during operation with the settings A (SB1). To solve the paper jam, a user adjusts the flow rates of the respective blowers (SB3). To perform the adjustment, the user selects the "multi-feed improvement" mode as the operation mode (SB4). Accordingly, the flow-rate control unit 530 increases the flow rates of the respective blowers by predetermined percentages stored in the mode setting unit 540. In this example, the flow rates of the lifting blower 330, the separating blower 340, the side blower 380, and the suction blower 390 are increased by α %, β %, γ %, and θ %, respectively (SB5). Thereafter, sheet feeding is resumed (SB6). The processes can be performed in a similar manner when no-sheet-feed occurs. When no-sheet-feed occurs, adjustment can be performed by selecting the "no-sheet-feed improvement mode".

Thus, according to the present invention, in a situation where the need of performing air adjustment for sheet feeding conveyance arises, the adjustment can be performed without requiring a user to perform complicated adjustment.

Figure 16:
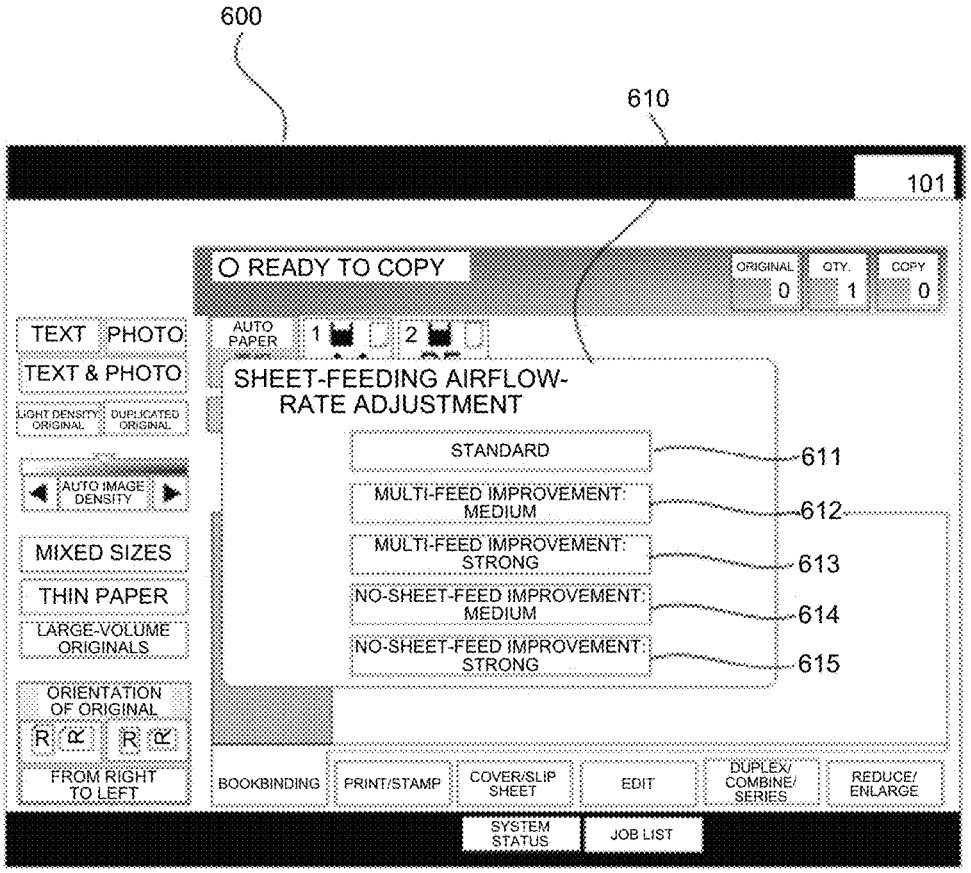
FIG. 16 is a diagram illustrating a screen displayed on an operation panel of the image forming apparatus when a mode for sheet-feeding airflow-rate adjustment is to be selected.

FIG. 16 is a diagram illustrating a screen displayed on the operation panel of the image forming apparatus when a mode for sheet-feeding airflow-rate adjustment is to be selected. In this example, the "standard" mode is selected when operation is performed normally but another operation mode is selected when multi-feed, no-sheet-feed, or the like occurs. In this example, an operation mode can be selected from "standard", "multi-feed improvement: medium", "multi-feed improvement: strong", "no-sheet-feed improvement: medium", and "no-sheet-feed improvement: strong". The mode setting unit 540 stores flow rates of the respective blowers in each of the operation modes. A sheet-feeding airflow-rate adjustment window 610 appears on the display unit 600 when the image forming apparatus enters an airflow-rate improvement mode. Areas 611 to 615 for use in selecting one of the modes are displayed in the sheet-feeding airflow-rate adjustment window 610.

A currently-selected operation mode is grayed out in the sheet-feeding airflow-rate adjustment window 610. Furthermore, the sheet-feeding airflow-rate adjustment window 610 allows a user to select one of the operation modes. For example, in a case where paper jam still repeatedly occurs even in the "multi-feed improvement: medium" mode, multi-feed can be improved by selecting the "multi-feed improvement: strong" mode where the flow rates are changed by greater percentages. The same applies to "no-sheet-feed".

According to an aspect of the present invention, disturbance of the behavior of the sheets that would otherwise be caused by air can be reduced by stopping blowing lifting air and separating air simultaneously during sheet conveyance, and occurrence of multiple-sheet-feed can be reduced, which leads to an increase in sheet separation capability.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A sheet separating device comprising:

a lifting nozzle configured to blow air against an end portion of a sheet bundle placed on a sheet loading portion to lift sheets;

a separating nozzle configured to separate the sheets;

a lifting-nozzle shutter member, the lifting-nozzle shutter member including a first plate configured to pivot to open and close the lifting nozzle;

a separating-nozzle shutter member, the separating-nozzle shutter member including a second plate configured to pivot to open and close the separating nozzle;

a driving mechanism configured to drive the lifting-nozzle shutter member and the separating-nozzle shutter member; and a controller configured to control the driving mechanism such that the first plate of the lifting-nozzle shutter member and the second plate of the separating-nozzle shutter member are opened or closed simultaneously.

2. The sheet separating device according to claim 1, wherein the controller is configured to close the lifting-nozzle shutter member and the separating-nozzle shutter member in accordance with sheet conveyance operation.

3. The sheet separating device according to claim 2, wherein the lifting-nozzle shutter member and the separating-nozzle shutter member are arranged on a single shaft such that, the driving mechanism simultaneously opens and closes the lifting-nozzle shutter member and the separating-nozzle shutter member by rotating the shaft.

4. The sheet separating device according to claim 2, wherein the lifting nozzle and the separating nozzle are arranged in communication with an air chamber, the lifting-nozzle shutter member is interposed between the lifting nozzle and the air chamber, and the separating-nozzle shutter member is interposed between the separating nozzle and the air chamber.

5. The sheet separating device according to claim 2,
wherein the sheet loading portion includes a sheet loading portion driver configured to move the placed sheet bundle up and down, and a sheet detector configured to detect a top surface position of the sheet bundle, and
the controller is configured to control the top surface position of the sheet bundle by controlling drive of the sheet loading portion driver.

6. A sheet feeding device comprising:
the sheet separating device according to claim 2; and
a sheet conveying device configured to convey the sheet separated by the sheet separating device.

7. The sheet separating device according to claim 1, wherein the controller is configured to open the lifting-nozzle shutter member and the separating-nozzle shutter member in accordance with sheet conveyance operation.

8. The sheet separating device according to claim 7, wherein the lifting-nozzle shutter member and the separating-nozzle shutter member each are a plate-like member and are arranged on a single shaft such that, the driving mechanism simultaneously opens and closes the lifting-nozzle shutter member and the separating-nozzle shutter member by rotating the shaft.

9. The sheet separating device according to claim 7, wherein the lifting nozzle and the separating nozzle are arranged in communication with an air chamber, the lifting-nozzle shutter member is interposed between the lifting nozzle and the air chamber, and the separating-nozzle shutter member is interposed between the separating nozzle and the air chamber.

10. The sheet separating device according to claim 7,
wherein the sheet loading portion includes a sheet loading portion driver configured to move the placed sheet bundle up and down, and a sheet detector configured to detect a top surface position of the sheet bundle, and
the controller is configured to control the top surface position of the sheet bundle by controlling drive of the sheet loading portion driver.

11. A sheet feeding device comprising:
the sheet separating device according to claim 7; and
a sheet conveying device configured to convey the sheet separated by the sheet separating device.

12. The sheet separating device according to claim 1, wherein the lifting-nozzle shutter member and the separating-nozzle shutter member are arranged on a single shaft such that, the driving mechanism simultaneously opens and closes the lifting-nozzle shutter member and the separating-nozzle shutter member by rotating the shaft.

13. The sheet separating device according to claim 12, wherein the lifting nozzle and the separating nozzle are arranged in communication with an air chamber, the lifting-nozzle shutter member is interposed between the lifting nozzle and the air chamber, and the separating-nozzle shutter member is interposed between the separating nozzle and the air chamber.

14. The sheet separating device according to claim 12,
wherein the sheet loading portion includes a sheet loading portion driver configured to move the placed sheet bundle up and down, and a sheet detector configured to detect a top surface position of the sheet bundle, and
the controller is configured to control the top surface position of the sheet bundle by controlling drive of the sheet loading portion driver.

15. The sheet separating device according to claim 1, wherein the lifting nozzle and the separating nozzle are arranged in communication with an air chamber, the lifting-nozzle shutter member is interposed between the lifting nozzle and the air chamber, and the separating-nozzle shutter member is interposed between the separating nozzle and the air chamber.

16. The sheet separating device according to claim 1, wherein
the sheet loading portion includes a sheet loading portion driver configured to move the placed sheet bundle up and down, and a sheet detector configured to detect a top surface position of the sheet bundle, and
the controller is configured to control the top surface position of the sheet bundle by controlling drive of the sheet loading portion driver.

17. A sheet feeding device comprising:
the sheet separating device according to claim 1; and
a sheet conveying device configured to convey the sheet separated by the sheet separating device.

18. An image forming apparatus comprising;
the sheet feeding device according to claim 17; and
an image formation unit configured to form an image on the sheets fed by the sheet feeding device.

19. A sheet separating device comprising:
a lifting nozzle configured to blow air against an end portion of a sheet bundle placed on a sheet loading portion to lift sheets;
a separating nozzle configured to separate the sheets;
a lifting-nozzle shutter member configured to open and close the lifting nozzle;
a separating-nozzle shutter member configured to open and close the separating nozzle;
a driving mechanism configured to drive the lifting-nozzle shutter member- and the separating-nozzle shutter member;
a suction conveying unit configured to suck the sheets one sheet by one sheet from the sheet bundle placed on the sheet loading portion and convey the sucked sheet using a belt;
an air suction unit configured to suck air from the suction conveying unit;
a side air nozzle configured to blow side air against a side surface of the sheet bundle placed on the sheet loading portion;
a side air blowing unit configured to deliver air to the side air nozzle;
a lifting blowing unit arranged at the lifting nozzle and configured to blow air through the lifting nozzle; and
a separating blowing unit arranged at the separating nozzle and configured to blow air through the separating nozzle; and
a controller configured to,
control the driving mechanism such that the lifting-nozzle shutter member and the separating-nozzle shutter member are opened or closed simultaneously,
adjust a suction rate of the air suction unit, a blowing rate of the side air blowing unit, a blowing rate of the lifting blowing unit, and a blowing rate of the separating blowing unit, and set the suction rate of the air suction unit and the blowing rates of the side air blowing unit, the lifting blowing unit, and the separating blowing unit in accordance with a plurality of preset modes.

20. The sheet separating device according to claim 19, wherein a mode is selected based on a condition of the sheets placed on the sheet loading portion.

* * * * *